United States Patent [19]

Selger

[11] 4,019,556

[45] Apr. 26, 1977

[54] AIR CONDITIONER COVER

[76] Inventor: Arthur G. Selger, 154 Johnson Ave., Dumont, N.J. 07628

[22] Filed: Apr. 28, 1976

[21] Appl. No.: 681,135

[52] U.S. Cl. ..... 160/238; 160/368 R

[51] Int. Cl.[2] ..... A47G 5/02

[58] Field of Search ..... 160/23 R, 238, 354, 160/368 R

[56] References Cited

UNITED STATES PATENTS

| | | | |
|---|---|---|---|
| 2,492,262 | 12/1949 | Boydon et al. | 160/238 |
| 2,537,611 | 1/1951 | Walton | 160/368 R |
| 3,002,236 | 10/1961 | Humphner | 160/354 |
| 3,063,062 | 11/1962 | Logan | 160/238 |
| 3,251,399 | 5/1966 | Grossman | 160/180 |
| 3,434,252 | 3/1969 | Dobson | 160/23 R |

*Primary Examiner*—Peter M. Caun
*Attorney, Agent, or Firm*—Allen D. Brufsky

[57] ABSTRACT

A cover for a window air conditioner unit adapted to cover and insulate the window as well as the air conditioner unit. The cover is attached to a window shade roller mounted at the top of the window frame in order to store the cover when not in use. "VELCRO" fastener strips are secured to the window frame andperipheral edges of the cover and when interengaged fasten the cover to the frame and insulate the interior of the cover.

5 Claims, 2 Drawing Figures

AIR CONDITIONER COVER

BACKGROUND OF THE INVENTION

This invention relates to a novel window air conditioner unit cover, and more partiuclarly, a cover which can be used to insulate the window through which the air conditioner is mounted during the winter.

It is common practice to leave window air conditioner units in their window mountings during the winter months. Usually, a flexible plastic cloth or cover is trapped onto the unit which projects exteriorly from the window to protect the unit from snow and to prevent drafts and cold air from entering the room through the air conditioner. However, these covers can be blown loose and do not prevent cold air from penetrating the window on either side of the unit through its mounting. Further, because of the air conditioner unit projecting from the window, no storm window can be mounted.

SUMMARY OF THE INVENTION

Accordingly, it is an object of the present invention to provide a window air conditioner cover which covers and insulates the entire window and air conditioner unit, thereby replacing the need of a conventional storm window.

A further object of this invention is to provide a window air conditioner cover of the character indicated which may be tightly sealed against the entire window frame.

Yet another object of this invention is to provide a window air conditioner cover which need not be removed and stored when the air conditioner is in use, but can be rolled up on a window shade roller and left on the window frame for easy accessibility and repeated use.

The air conditioner unit cover of the present invention consists of a cover for a window air conditioner unit projecting outwardly from a window frame comprising:

a window shade roller adapted to be mounted on the top of a window frame;

a flexible sheet of transparent plastic material having a plurality of foldable panels which form a box-like shape to cover an air conditioner unit attached to the window shade roller; and means on the periphery of the flexible sheet for fastening the sheet to a window frame.

BRIEF DESCRIPTION OF THE DRAWING

Further objects and advantages of the present invention will become more apparent from the following description and claims, and from the accompanying drawing, wherein:

DETAILED DESCRIPTION OF THE PREFERRED EMBODIMENT

Figure 1:
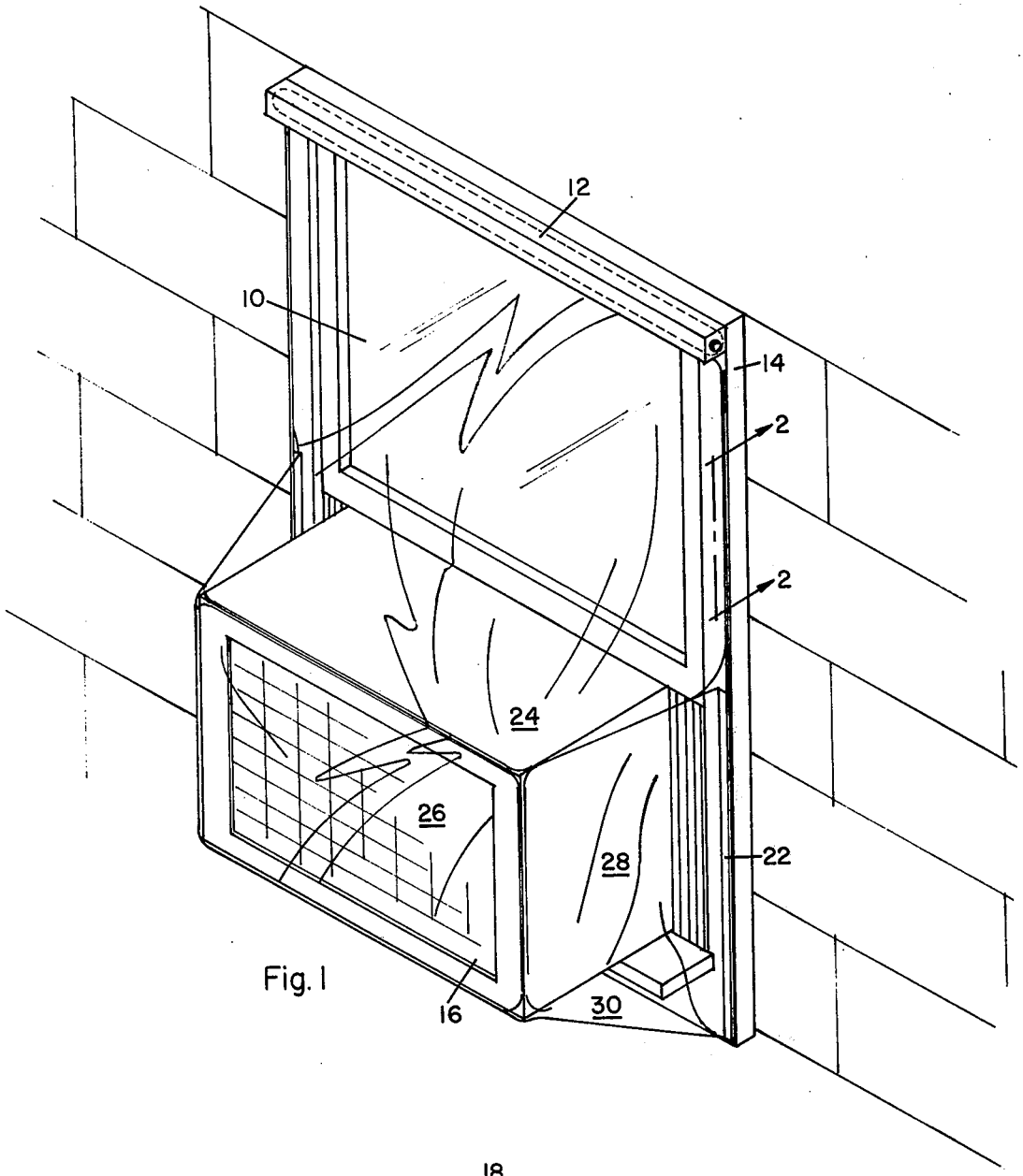
FIG. 1 is a perspective view of the air conditioner unit cover of the present invention mounted on a window frame in its use position.
Figure 2:
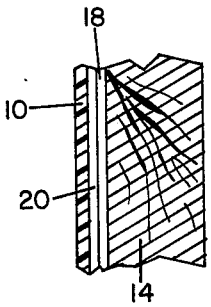
FIG. 2 is a cross-sectional view taken substantially along the plane indicated by line 2—2 of FIG. 1.

Referring now to the drawing in detail, wherein like numerals indicate like elements throughout the several views, the air conditioner cover 10 of the present invention includes a flexible sheet of transparent soft plastic material attached to a conventional window shade roller 12 mounted at the top of a window frame 14 having a window air conditioner unit 16 projecting outwardly therefrom.

A continuous strip fastener element 18 having an exposed nap formation provided on its exterior side is adhesively connected to the periphery of window frame 14. A wimilar strip fastener element 20 is adhesively connected to the back surface of a cover 10 along its peripheral edge and the back surface of a flange 22 of cover 10 which extends inwardly from the opposite peripheral edges of cover 10 where the cover juts outwardly to form a top panel 24, a front panel 26, two side panels 28 and a bottom panel 30 to cover the air conditioner unit 16.

Strip fastener elements 18 and 20 form a separable fastener of type known as "VELCRO". This type of fastener employs two like flexible strips of fabric that constitutes a backing for a dense, fibrous or thread-like nap. When strip fastener elements 18 and 20 are brought into contacting engagement under slight pressure, the nap on each element will interengage or interlock to hold the elements tightly together. Separation of the elements 18 and 20 is effected by simply pulling the strips apart.

To use cover 10, it is only necessary to pull the cover down from its rolled up condition on roller 12, unfold panels 24, 26, 28 and 30 extending there about air conditioner unit 16, and interlock the strip fastener element 20 on cover 10 with the strip fastener element 18 on window frame 14. Not only is unit 16 covered, but the entire window is covered and insulated by cover 10 which is tightly sealed about its edges to window frame 14.

To store cover 10, fastener elements 18 and 20 are separated, panels 24, 26, 28 and 30 folded into a single planar sheet and rolled up on roller 12. I claim:

1. A cover for a window air conditioner unit projecting outwardly from a window frame comprising:

a window shade roller adapted to be mounted on the top of a window frame;

a flexible sheet of transparent plastic material having a plurality of foldable panels which form a box-like shape to cover an air conditioner unit attached to said window shade roller; and means on the periphery of said flexible sheet for continuously fastening said sheet to a window frame.

2. A cover in accordance with claim 1, wherein said fastening means includes an engageable and disengageable strip fastener between said flexible sheet and window frame having an exposed nap formation adapted to be interlocked with a similar strip fastener on said window frame.

3. A cover in accordance with claim 1, wherein said flexible sheet corresponds in length and width to said window frame.

4. A cover in accordance with claim 1, wherein said flexible sheet includes a top, two sides, and a bottom panel, said side panels having a flange, and said fastening means being on said flange.

5. A cover in accordance with claim 4, wherein the remaining peripheral edges of said flexible sheet includes said fastening means.

* * * * *